US012800172B2

(12) United States Patent
Stluka et al.

(10) Patent No.: US 12,800,172 B2
(45) Date of Patent: Nov. 17, 2026

(54) ENERGY OPTIMIZATION OF HVAC SYSTEMS UNDER VARIABLE VENTILATION CONDITIONS

(71) Applicant: Honeywell International Inc., Charlotte, NC (US)

(72) Inventors: Petr Stluka, Zbuzany (CZ); Karel Marik, Revnice (CZ); Petr Endel, Prague (CZ)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 950 days.

(21) Appl. No.: 17/933,236

(22) Filed: Sep. 19, 2022

(65) Prior Publication Data

US 2024/0093899 A1 Mar. 21, 2024

(51) Int. Cl.
*F24F 11/63* (2018.01)

(52) U.S. Cl.
CPC ..... *F24F 11/63* (2018.01)

(58) Field of Classification Search
None
See application file for complete search history.

(56) References Cited

U.S. PATENT DOCUMENTS

| | | | |
|---|---|---|---|
| 7,044,397 | B2 | 5/2006 | Bartlett et al. |
| 9,741,082 | B2 | 8/2017 | Holub et al. |
| 10,481,045 | B2 | 11/2019 | Roosli et al. |
| 10,697,660 | B2 | 6/2020 | Roosli |
| 11,248,819 | B2 | 2/2022 | Slimacek et al. |
| 11,874,008 | B2 | 1/2024 | Dempsey et al. |
| 12,566,017 | B2 | 3/2026 | Schindler et al. |
| 2010/0263391 | A1 | 10/2010 | Tetu et al. |
| 2011/0146651 | A1 | 6/2011 | Puranen et al. |
| 2013/0339080 | A1 | 12/2013 | Beaulieu et al. |
| 2015/0073732 | A1 | 3/2015 | Lee et al. |
| 2017/0146259 | A1 | 5/2017 | Zhao et al. |
| 2017/0336119 | A1 | 11/2017 | McDonough et al. |
| 2019/0293313 | A1 | 9/2019 | Reeve et al. |

(Continued)

FOREIGN PATENT DOCUMENTS

| | | | |
|---|---|---|---|
| CN | 101178412 | A * | 5/2008 |
| JP | 2014185846 | A * | 10/2014 |

*Primary Examiner* — Kamini S Shah
*Assistant Examiner* — Anzuman Sharmin
(74) *Attorney, Agent, or Firm* — Seager, Tufte & Wickhem, LLP

(57) ABSTRACT

Systems and methods for energy optimization of an HVAC system of a building are disclosed. The method includes collecting data from field sensors, the data including damper positions of a plurality of air handling units; calculating an aggregated ventilation rate for the air handling units based on the damper positions; retrieving a predictive model that outputs a predicted state for a plurality of building zones; inputting the damper positions to the predictive model; retrieving a baseline model that outputs an expected energy cost for a reporting period; inputting the aggregated ventilation rate to the baseline model; performing batch data analytics on the predictive model to update a building model; optimizing energy use to minimize actual energy cost based on the building model, energy cost information, and the data collected from the field sensors; generating energy savings data based on the baseline model and the actual energy cost.

17 Claims, 7 Drawing Sheets

(56) References Cited

U.S. PATENT DOCUMENTS

| | | | | |
|---|---|---|---|---|
| 2019/0293316 | A1 | 9/2019 | Reeve et al. | |
| 2019/0293318 | A1 | 9/2019 | Reeve et al. | |
| 2020/0149763 | A1 | 5/2020 | Mukherjee et al. | |
| 2020/0309397 | A1 | 10/2020 | Dempsey | |
| 2020/0379423 | A1* | 12/2020 | Wenzel | G05B 17/02 |
| 2021/0018205 | A1* | 1/2021 | Ellis | F24F 11/47 |
| 2021/0199325 | A1 | 7/2021 | Wu et al. | |
| 2022/0186962 | A1* | 6/2022 | Turney | F24F 11/47 |
| 2023/0011991 | A1 | 1/2023 | Xu et al. | |
| 2023/0144675 | A1 | 5/2023 | Cluff | |
| 2023/0250987 | A1* | 8/2023 | Du | F24F 11/63 700/276 |
| 2024/0093893 | A1 | 3/2024 | Mannfeld et al. | |
| 2024/0093899 | A1 | 3/2024 | Stluka et al. | |
| 2025/0043981 | A1 | 2/2025 | Hill-Spranger et al. | |
| 2025/0067452 | A1 | 2/2025 | Aggarwal et al. | |

* cited by examiner

ENERGY OPTIMIZATION OF HVAC SYSTEMS UNDER VARIABLE VENTILATION CONDITIONS

TECHNICAL FIELD

Various embodiments of the present disclosure generally relate to energy optimization and, more particularly, to systems and methods for energy optimization of a building HVAC system.

BACKGROUND

Optimal heating, ventilation, and air conditioning (HVAC) control is a key component of the energy optimization of modern buildings. Generally, the aim of optimal HVAC control is to achieve a balance between minimizing energy costs and maximizing the comfort level of the occupants of the building. The comfort level of the occupants may be impacted by the temperature, humidity, and other environmental factors experienced in the building.

One aspect of maintaining the comfort and air quality in a building is to control the ventilation rate via damper positions in the air handling units that deliver air to specified building zones. Typically, the amount of flowing air is maintained at a level required by regulations specifying the minimum fresh air intake for a building zone. This helps achieve consistent behavior of HVAC systems whose energy costs can be optimized continuously and without interruption based on a predictable and stable ventilation rate. Recently, there is an increased interest in increasing the intake of outside air and varying the ventilation rate in response to occupancy rates, as higher ventilation rates ensure air circulation that decreases the risk of infection from airborne diseases. This increase in ventilation rates directly conflicts with most energy optimization solutions, which are unable to account for a variation in the desired ventilation rates in HVAC systems.

The present disclosure is directed to overcoming this above-referenced challenge.

SUMMARY OF THE DISCLOSURE

According to certain aspects of the disclosure, systems and methods are disclosed for energy optimization of a building HVAC system.

In one aspect, computer-implemented method for energy optimization of an HVAC system of a building, the method comprising: collecting, using at least one processor, data from field sensors, the data including damper positions of a plurality of air handling units; calculating, using the at least one processor, an aggregated ventilation rate for the air handling units based on the damper positions; retrieving, using the at least one processor, a predictive model that outputs a predicted state for a plurality of building zones; inputting, using the at least one processor, the damper positions to the predictive model; retrieving, using the at least one processor, a baseline model that outputs an expected energy cost for a reporting period; inputting, using the at least one processor, the aggregated ventilation rate to the baseline model; performing, using the at least one processor, batch data analytics on the predictive model to update a building model; retrieving, using the at least one processor, energy cost information; optimizing, using the at least one processor, energy use to minimize actual energy cost based on the building model, the energy cost information, and the data collected from the field sensors; generating, using the at least one processor, energy savings data based on the baseline model and the actual energy cost; and sending the energy savings data to be displayed at a user portal for visualization and notification.

In another aspect, a system for energy optimization of an HVAC system of a building is disclosed. The system may include: a memory having processor-readable instructions therein; and at least one processor configured to access the memory and execute the processor-readable instructions, which when executed by the processor configures the processor to perform a plurality of functions, including functions for: collecting data from field sensors, the data including damper positions of a plurality of air handling units; calculating an aggregated ventilation rate for the air handling units based on the damper positions; retrieving a predictive model that outputs a predicted state for a plurality of building zones; inputting the damper positions to the predictive model; retrieving a baseline model that outputs an expected energy cost for a reporting period; inputting the aggregated ventilation rate to the baseline model; performing batch data analytics on the predictive model to update a building model; retrieving energy cost information; optimizing energy use to minimize actual energy cost based on the building model, the energy cost information, and the data collected from the field sensors; generating energy savings data based on the baseline model and the actual energy cost; and sending the energy savings data to be displayed at a user portal for visualization and notification.

In yet another aspect, a computer-readable medium containing instructions for energy optimization of an HVAC system is disclosed. The instructions include: collecting data from field sensors, the data including damper positions of a plurality of air handling units; calculating an aggregated ventilation rate for the air handling units based on the damper positions; retrieving a predictive model that outputs a predicted state for a plurality of building zones; inputting the damper positions to the predictive model; retrieving a baseline model that outputs an expected energy cost for a reporting period; inputting the aggregated ventilation rate to the baseline model; performing batch data analytics on the predictive model to update a building model; retrieving energy cost information; optimizing energy use to minimize actual energy cost based on the building model, the energy cost information, and the data collected from the field sensors; generating energy savings data based on the baseline model and the actual energy cost; and sending the energy savings data to be displayed at a user portal for visualization and notification.

Additional objects and advantages of the disclosed embodiments will be set forth in part in the description that follows, and in part will be apparent from the description, or may be learned by practice of the disclosed embodiments. The objects and advantages of the disclosed embodiments will be realized and attained by means of the elements and combinations particularly pointed out in the appended claims.

It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Figure 1:
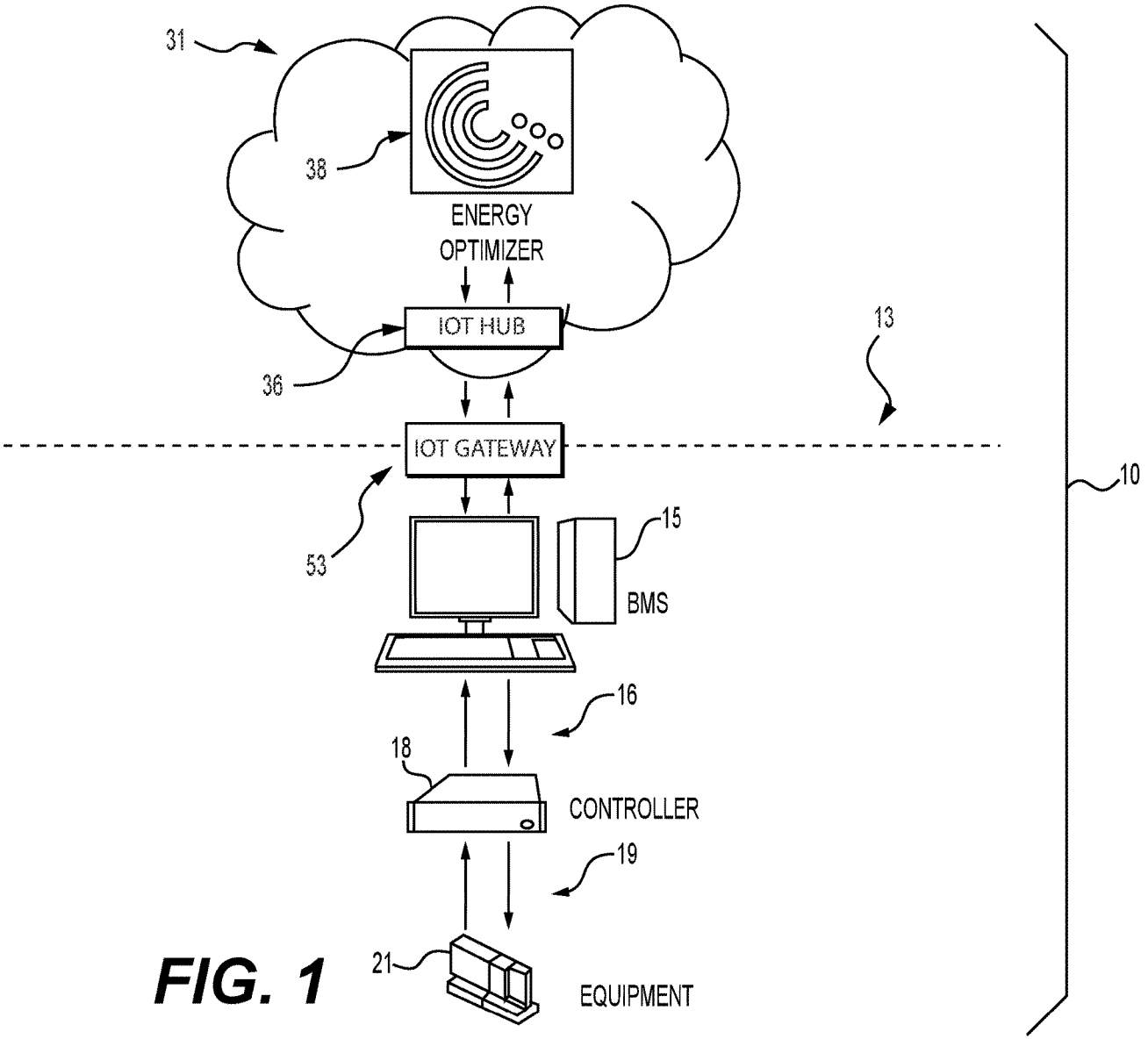
FIG. 1 depicts a diagram of an architecture of the system for energy optimization, according to one or more embodiments.

The following embodiments describe systems and methods for energy optimization of the HVAC system of a building. One aspect of maintaining the comfort and air quality in a building is to control the ventilation rate via damper positions in the air handling units that deliver air to specified building zones. Typically, the amount of flowing air is maintained at a level required by regulations specifying the minimum fresh air intake for a building zone. This helps achieve consistent behavior of HVAC systems whose energy costs can be optimized continuously and without interruption based on a predictable and stable ventilation rate. Recently, there is an increased interest in increasing the intake of outside air and varying the ventilation rate in response to occupancy rates, as higher ventilation rates ensure air circulation that decreases the risk of infection from airborne diseases. This increase in ventilation rates directly conflicts with most energy optimization solutions, which are unable to account for a variation in the desired ventilation rates in HVAC systems.

In one exemplary embodiment, an energy optimization system and method is provided that includes cloud side computing processes to advantageously and efficiently monitor the energy consumption patterns of a building's HVAC system and automatically adjust for optimal energy savings without sacrificing occupant comfort levels.

The system and method incorporates cloud-based model predictive control that incorporates a variety of factors, including historical set-points for equipment in the HVAC system, outside air temperature, occupancy levels, historical information about the building's HVAC systems (e.g, temperature and humidity in specified building zones, where a building zone may be defined as a room, a floor, or a wing, etc.), and more.

The equipment in the HVAC system may include a chiller plant, a boiler plant, and air distribution systems including a plurality of air handling units. Individual HVAC controllers (on chiller plant, boiler plant, and air handling units) are responsive to the energy optimization system to control a variety of functions at the equipment level to operate at optimal efficiency, i.e., maintaining the comfort of the occupants of the building and minimizing energy usage. The control functions of a chiller plant include plant staging and/or sequencing, cooling tower control, intake temperature settings, and control settings for a water pump, condenser, compressor, or other elements in the chiller plant. Similarly, the control functions for the boiler plant include plant staging and/or sequencing, water pump control, and further include a firing rate control. These control functions are likewise controlled by a controller that is responsive to the energy optimization system and method.

The energy optimization system and method can direct main set-points for the chiller plant and the boiler plant and these changes are further propagated through these internal control functions. These main set points will typically include water supply temperatures and differential pressures for both plants. In order to differentiate the two, the water supply temperature to the chiller plant is referred to as the cold water supply temperature, and for the boiler plant, the hot water supply temperature.

Advantageously, the energy optimization system and method can further direct set-points for the air distribution system, including air supply temperature and static pressure, higher static pressures being required for higher ventilation rates. The control functions within the air handling units include the control loops for the hot and cold coils, the fan variable speed control, and damper controls to determine the volumetric flow rate out of each air handling unit. The control functions are operated at a lower-level controller at the air handling units. However, an increase amount of ventilation in a "healthy mode" operation increases variation in ventilation rate. This invention recognizes a need to incorporate the increased ventilation rate into the system-level optimization model.

To this end, the model predictive control relies on a predictive model that provides information and control parameters. The predictive model receives as inputs recent conditions in building zones, recent actions performed on HVAC equipment, and information about disturbances that may affect the recent conditions in the building zones, and outputs predicted conditions of specified building zones. This predictive model is used continually, e.g. every 15 minutes (or other period), by the optimization engine.

The baseline model is used to determine the expected energy costs of a given HVAC system, over the specified reporting period, which may be set to 24 hours/1 day, or any other reporting period of interest. The baseline model receives as inputs the outside air temperature, a value reflecting the type of day, and other independent variables that may affect energy costs at that point in time, and outputs the expected energy costs.

Advantageously, the predictive model and baseline model include inputs that have been identified to account for variable ventilation rates. Air handling units are an integral part of any HVAC system and are used as the means of intaking air from outside the building, conditioning the air, and transferring the air into the building. The intake portions of the air handling units include dampers that may be adjusted to allow for a variable amount of air into the building, with a fully closed damper blocking air intake to the air handling unit, and a fully open damper allowing for maximum intake of air to the air handling unit. Field sensors may be provided to determine the damper position of the air handling units, and input this information into the predictive model.

Similarly, a value representing the aggregated ventilation rate may be input into the baseline model, as increased intake at the air handling units equates to an increase in the amount of air that needs to be conditioned. Conditioning the outside air, i.e., pre-heating or pre-cooling it, is a significant source of energy costs. Generally, multiple air handling units are provided in a building, often with one air handling unit for a group of building zones, and each air handling unit may be of a different size. As such, aggregating the ventilation rate of a plurality of air handling units involves a calculation that weights the larger air handling units more so than the smaller air handling units.

While principles of the current disclosure are described with reference to online content, it should be understood that the disclosure is not limited thereto. Rather, the systems and methods of the present disclosure may be used in any networked system with user interfaces to provide specified content to holders of virtual tokens related to the content providers. Reference will now be made in detail to the exemplary embodiments of the disclosure, examples of which are illustrated in the accompanying drawings. Wherever possible, the same reference numbers will be used throughout the drawings to refer to the same or like parts.

FIG. 1 is a schematic diagram of an exemplary architecture 10 for the present system. There is a cloud side 31, with an IoT hub 36 and an energy optimizer 38. An IoT Gateway 53 is provided to connect edge side 13 elements to the cloud The cloud 31 may receive building management system data from building management system 15 via the IoT Gateway 53. Building management system 15 may have a two way connection 16 with a controller 18, which has a two way connection 19 with equipment 21.

Cloud 31 may perform analytics on information provided to it and provide reports. Cloud 31 may provide data analytics, performance monitoring, improvement recommendations and model update information.

Figure 2:
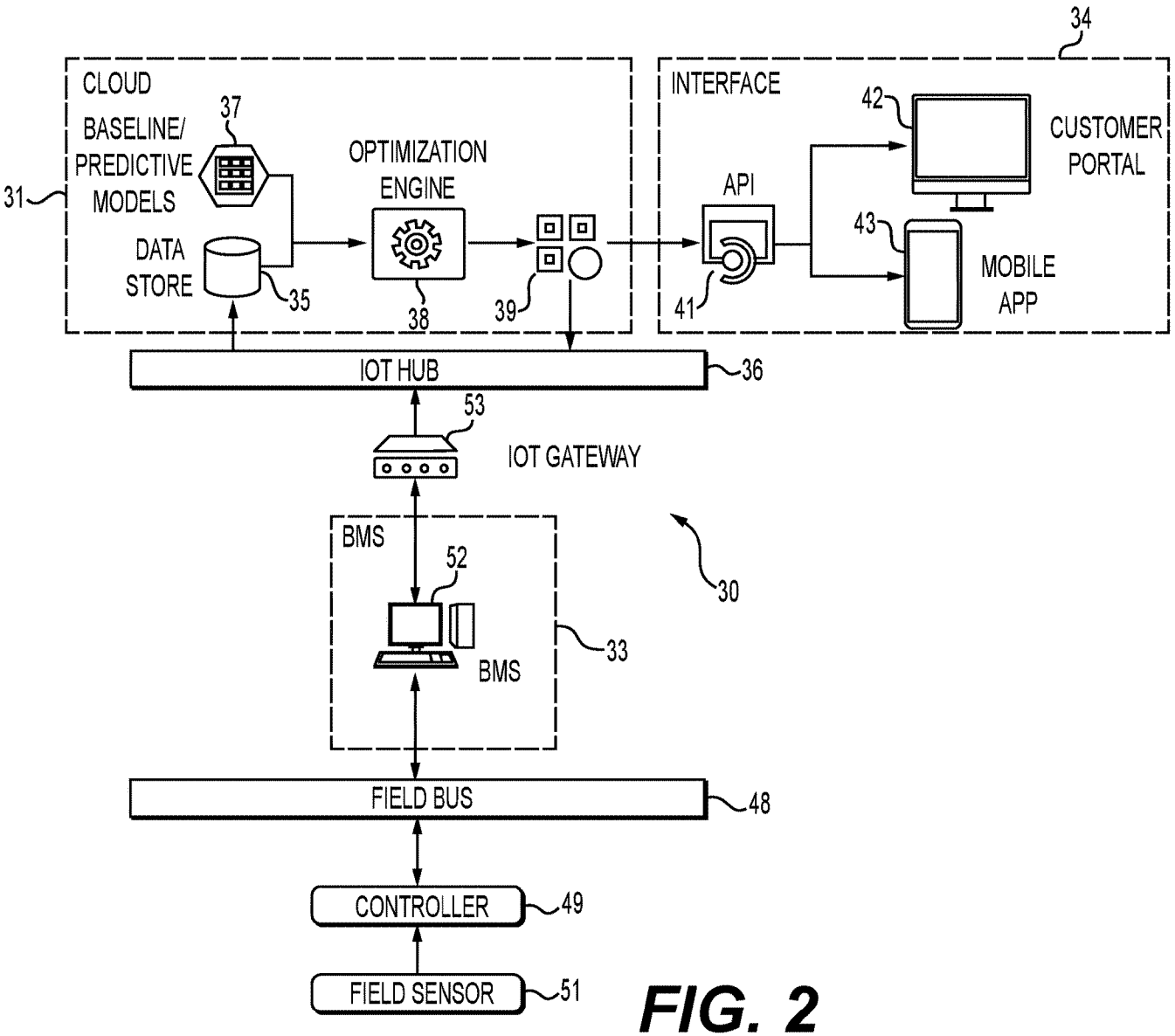
FIG. 2 depicts a diagram of the system for energy optimization, according to one or more embodiments.

FIG. 2 is a diagram of the system 30 for energy optimization. Major components of system 30 may incorporate a cloud 31, optimizer 38, building management system module 33, and interface 34. Cloud 31 may receive data to its data store 35 from the IoT hub 36. Data from data store 35 and information from predictive model 371 and a baseline model 372 may be stored in model module 37 and may be transferred to the optimization engine 38. Results from the optimization engine 38 may be delivered to a module 39, where the information is relayed from module 39 to IoT hub 36 and to an application programmable interface (API) 41 of interface 34. An output from API may go to a customer portal 42, a mobile app 43, and other outputs of interface 34.

The module 39 communicates specific actions determined by the optimization engine to the BMS 33 via IoT hub 36 responsive to predictive model 371. These actions include new temperature and/or flow rate set points for equipment 21 in response to varying ventilation rates and other factors. This process is performed continuously and without interruption at a frequent interval, such as every 15 minutes, to ensure energy optimization is in keeping with real-time conditions.

The module 39 communicates results of the energy optimization, e.g., amount of energy savings achieved, to the API 41. The baseline model 372 is used to calculate savings data with respect to varying ventilation rates. This process is performed less frequently than the communication of actions, such as once every 24 hours.

A building management system 52 of building management system module 33 may have a two-way connection with field bus 48 and another two-way connection with optimization engine 47 of optimizer 32. Another cloud connector 53 may have an input from building management system 52 of module 33 and an output connected to IoT hub 36.

BMS 33 provides information to the cloud 31 via IoT gateway 36, with BMS having an input from a field bus 48 which may have a two-way connection with a controller 49, which may monitor or control information or data from one or more field sensors 51, to or from field bus 48. Field sensors 51 may be placed so as to obtain data of a building, facility, enclosed environment, and/or the like, relating to temperature, humidity, ventilation rate, noise, fumes, physical disturbance, and/or other detectable parameters. These parameters may be used both to determine the conditions in the building zones, particularly with respect to the comfort of the occupants within the building zones, and to monitor the conditions of the equipment 21 in the HVAC system, which is described in more detail with respect to FIG. 3.

Figure 3:
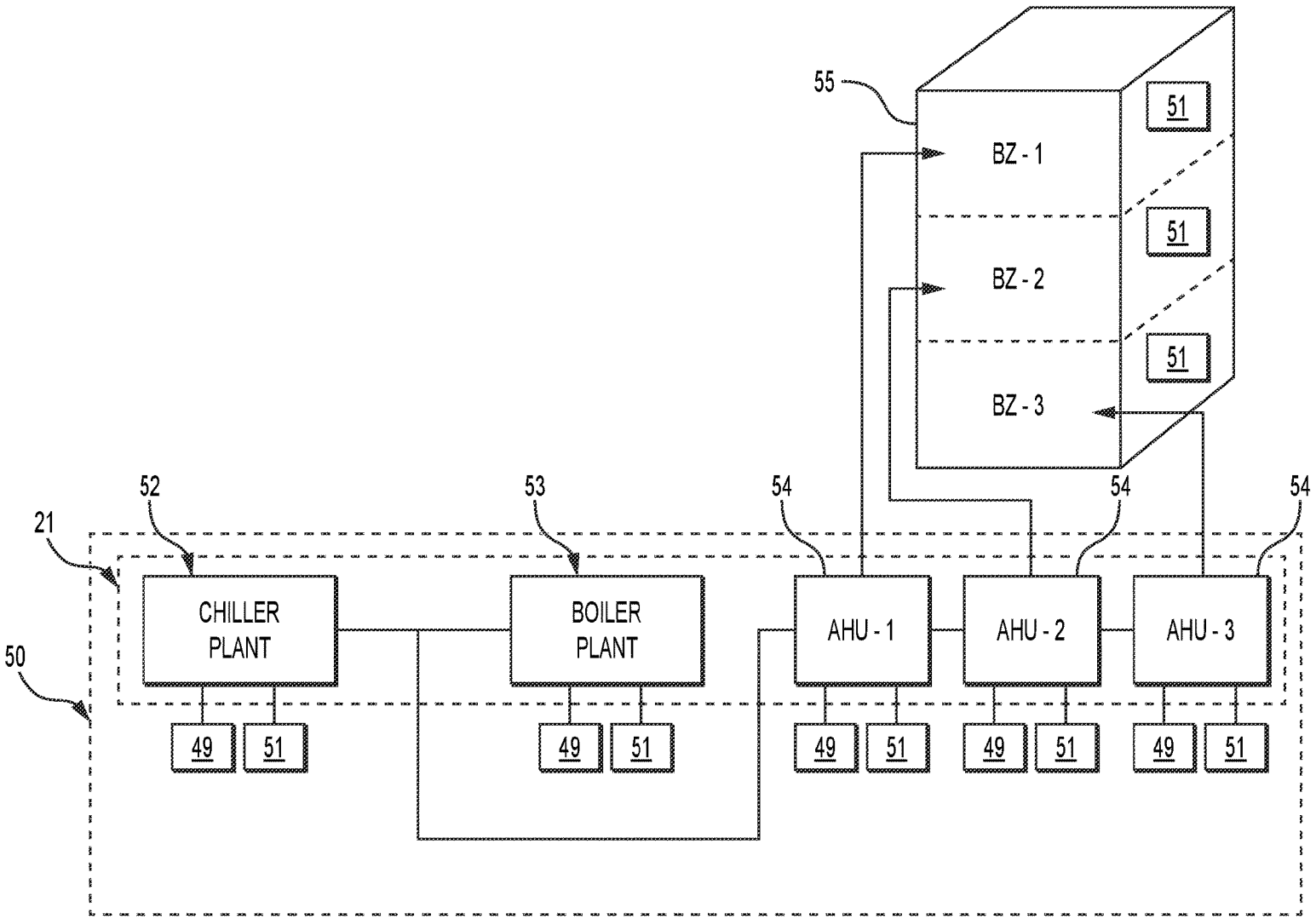
FIG. 3 depicts a diagram of an HVAC system incorporating the system for energy optimization.

FIG. 3 is a schematic diagram of the HVAC system integrated with the energy optimization system and method described in the present invention. The HVAC system 50 is comprised of equipment 21 for pre-heating, pre-cooling, and delivering conditioned air, including a chiller plant 52, a boiler plant 53, and a plurality of air handling units 54. The conditioned air is delivered from the air handling units into respective building zones 55. In the exemplary embodiment shown in FIG. 3, there are three building zones 55 being separately conditioned by respective air handling units 54, with first air handling unit AHU-1 providing conditioned air to first building zone BZ-1, second air handling unit AHU-2 providing conditioned air to second building zone BZ-2, and third air handling unit AHU-3 providing conditioned air to third building zone BZ-3. Any number of building zones may be separately conditioned, with a corresponding air handling unit for each zone. Field sensors 51 are provided to measure conditions within the building zones and to monitor conditions of the equipment 21 of the HVAC system 50.

Whenever the conditions measured by field sensors 51 demand operation of the HVAC system 50, e.g., a temperature falling below or above a threshold, or an occupancy level requiring a higher ventilation rate, the energy optimization system is activated to generate an optimal operation based on the models stored in building model module 45. These models include controlling and setting optimal set points for the equipment 21 in the HVAC system 50.

The set points may include cold water supply temperature and pressure differential for the chiller plant 52, and hot water supply temperature and pressure differential for the boiler plant 53. The set points are communicated to controllers 49 that act on the equipment directly. The controller 49 at the chiller plant is responsive to the energy optimization system to control a variety of functions at the equipment level to operate at optimal efficiency. The control functions of the chiller plant 52 include plant staging and/or sequencing, cooling tower control, intake temperature settings, and control settings for a water pump, condenser, compressor, or other elements in the chiller plant 52. The controller 49 at the boiler plant is responsive to the energy optimization system to control a similar variety of functions, including plant staging and/or sequencing, water pump control, and further include a firing rate control.

Figure 4:
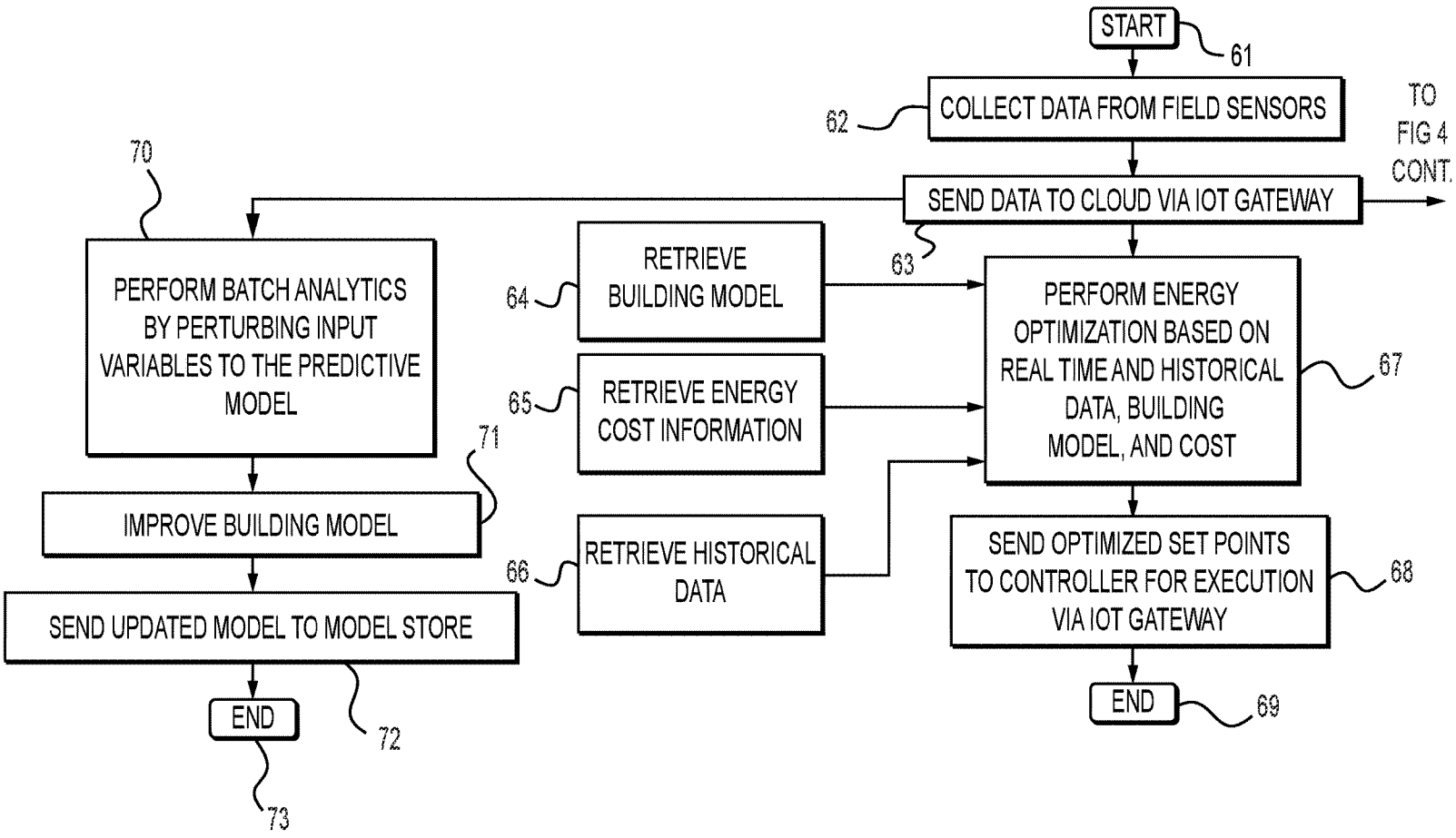
FIG. 4 depicts a flowchart of a method for energy optimization of the system of FIGS. 1-3.
Figure 4:
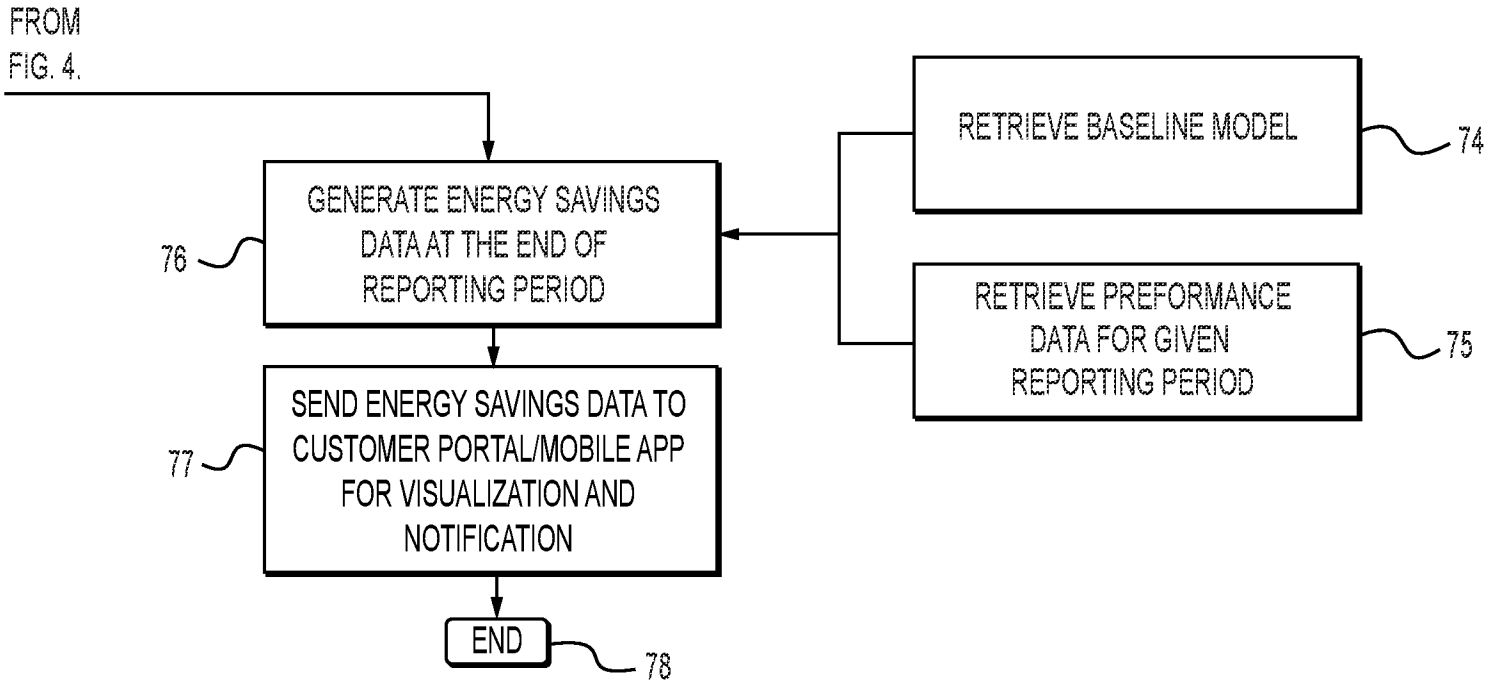

The energy optimization system and method can further direct set-points for the air handling units 54, including air supply temperature and static pressure. These set points are sent to controller 49 for an air distribution system that includes all of the air handling units 54, or each air handling unit 54 may be provided with its own controller. FIG. 4 discusses in more depth the operation within the energy optimization system for determining the optimal set points and updating the models for continued optimization.

FIG. 4 is a flowchart of a method for energy optimization of the system that may be used for illustrative purposes. From a start 61, one may go to block 62 to collect data from the field sensors 51, and send the data to the cloud 31 via IoT gateway 53. Three processes are commenced once the data is introduced to the cloud 31. One process is begins at box 67, whereby energy optimization is performed based on real-time and historical data, a building model, and cost information. A second process begins at box 70, whereby batch data analytics are performed to improve the building model based by perturbing input variables to the predictive model 371. Yet a third process begins at box 76, whereby energy savings data is generated using the baseline model 372. The first and second processes described, namely the energy optimization process and the performance of batch data analytics, are performed more frequently than the third process, generating and reporting energy savings data. In an exemplary embodiment, the first two processes are performed every 15 minutes, while the third process is performed once a day. However, any reasonable time period may be used for any of the three processes.

The energy optimization process beginning at block 67 involves the cloud 31 retrieving information required for the optimization. A building model may be retrieved from a block 64 and real-time information about the current cost of energy may be retrieved from a block 65. At block 67, optimized set points are determined for the equipment 21 depicted in FIG. 3. As discussed above, the set points may include cold water supply temperature and pressure differential for the chiller plant 52, hot water supply temperature and pressure differential for the boiler plant 53, and air supply temperature and static pressure for the air handling units 54. Optimized set points from block 67 may be sent by block 68 to a field controller 18 as shown in FIG. 1, the controller 18 setting the set points for equipment 21 for optimal operation of the field equipment given the current building model, the energy cost information, and historical data related to energy use and equipment performance. This ends the control flow as indicated by block 69, which will be repeated in a next iteration, repeated every 15 minutes in an exemplary embodiment.

Batch data analytics is performed at block 70 on the predictive model by perturbing the inputs to the predictive model in order to update the building model retrieved in block 64. Described in more detail in FIG. 5, the predictive model is perturbed by testing alternative input variables, including but not limited to damper positions of the air handling units to incorporate changes introduced by a variable ventilation rate. These perturbances allow for improvements to be made to the building model based on real-time information, and the updated model is sent to the model store at block 72. This ends the batch data analytics flow as indicated by block 73, which will be repeated in a next iteration, repeated every 15 minutes in an exemplary embodiment.

At block 76, a separate process is initiated whereby energy savings data is generated at the end of a reporting period. This is done by retrieving a baseline model, described in more detail in FIG. 6 at box 74, and retrieving the performance data for the given reporting period in box 75. The performance data includes the energy costs accrued in the reporting period, and may also include data regarding the conditions in the building, such as temperature, humidity, occupancy rates, etc., and operational data of the HVAC equipment, such as the chiller plant, the boiler plant, and the air handling units. Once the energy savings data is generated, it and other insights are sent to the customer portal or mobile app for visualization and notification, as shown in box 77. This ends the process for the reporting period as shown in box 78, and the reporting period is generally a time frame longer than those of the other processes. In an exemplary embodiment, the reporting period is 24 hours. This then allows for a model to output the expected energy cost for a reporting period, such that the present invention may use that baseline model to report the energy savings associated with the energy optimization performed at the cloud on the building in the reporting period.

Figure 5:
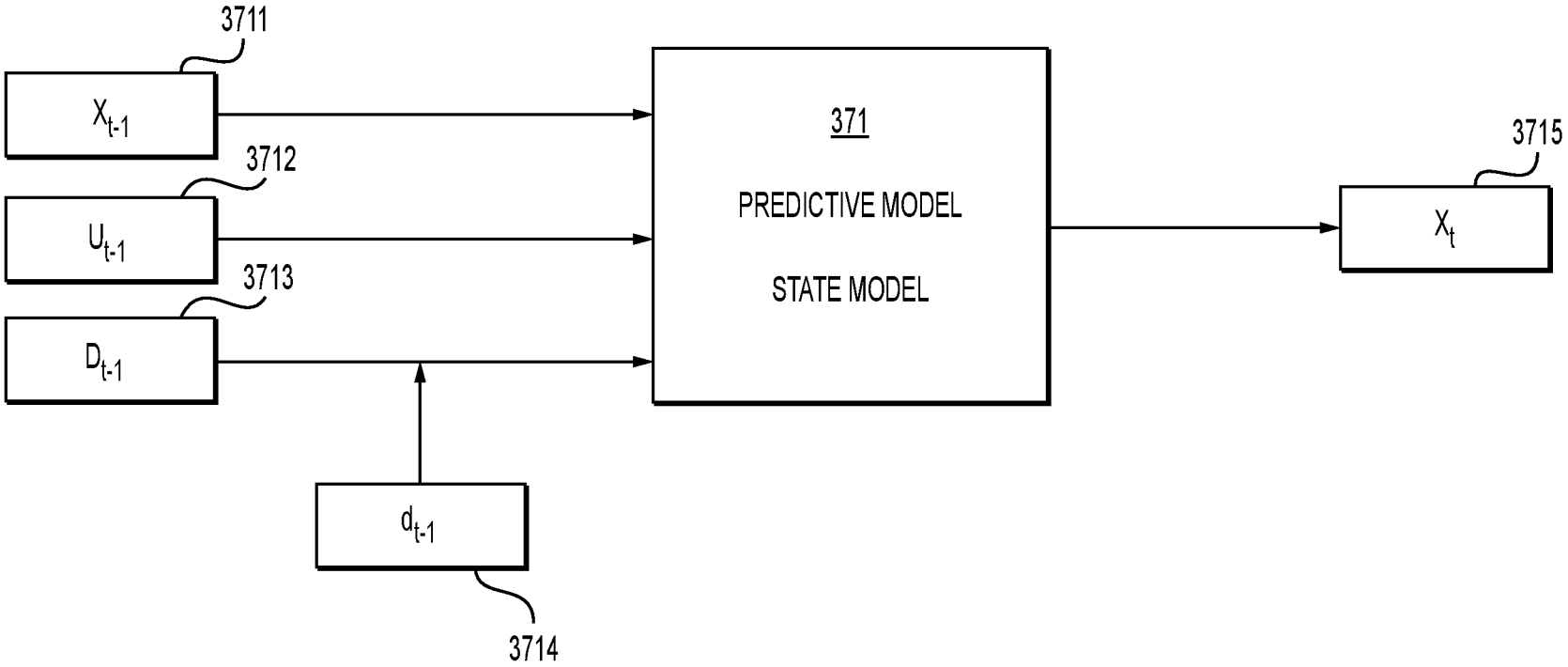
FIG. 5 depicts a block diagram of the inputs and outputs of the predictive model of FIG. 2.

FIG. 5 describes the predictive model used for predicting the conditions in building zones. The predictive model 371 receives, as inputs, information about recent states $X_{t-1}$ at 3711, actions $U_{t-1}$ at 3712, and disturbances $D_{t-1}$ and $d_{t-1}$ at 3714. Information about recent states 3711 includes recent conditions in the building zones as measured by the field sensors, such as temperature, humidity, etc. Information regarding actions 3712 takes the form of the values of the current set-points for the HVAC equipment, such as flow rates of the air handling units, temperatures and pressures of the chiller plant and boiler plant, etc.

The disturbances input at 3713 and 3714 include outside air temperature and occupancy levels and, of particular importance in a post-covid era, damper positions $d_{t-1}$ that provide the predictive state model with a measure of the degree to which air flow is increased, affecting the predicted state $X_t$, represented at block 37. The damper positions $d_{t-1}$ are a dimensionless value that represent the degree of opening of the respective dampers on each of the plurality of air handling units, with a larger opening and hence a larger value indicating a larger air flow rate through the particular air handling unit. As there may be a plurality of air handling units, the damper positions of each of the air handling units is input into the predictive model.

Predicted state $X_t$ is indicative of the conditions (e.g., temperatures, humidity) that would prevail in the building zone based on the impact of the actions $U_{t-1}$ and disturbances $D_{t-1}$ and $d_{t-1}$ on the recent states $X_{t-1}$ as determined by the predictive model 371.

Figure 6:
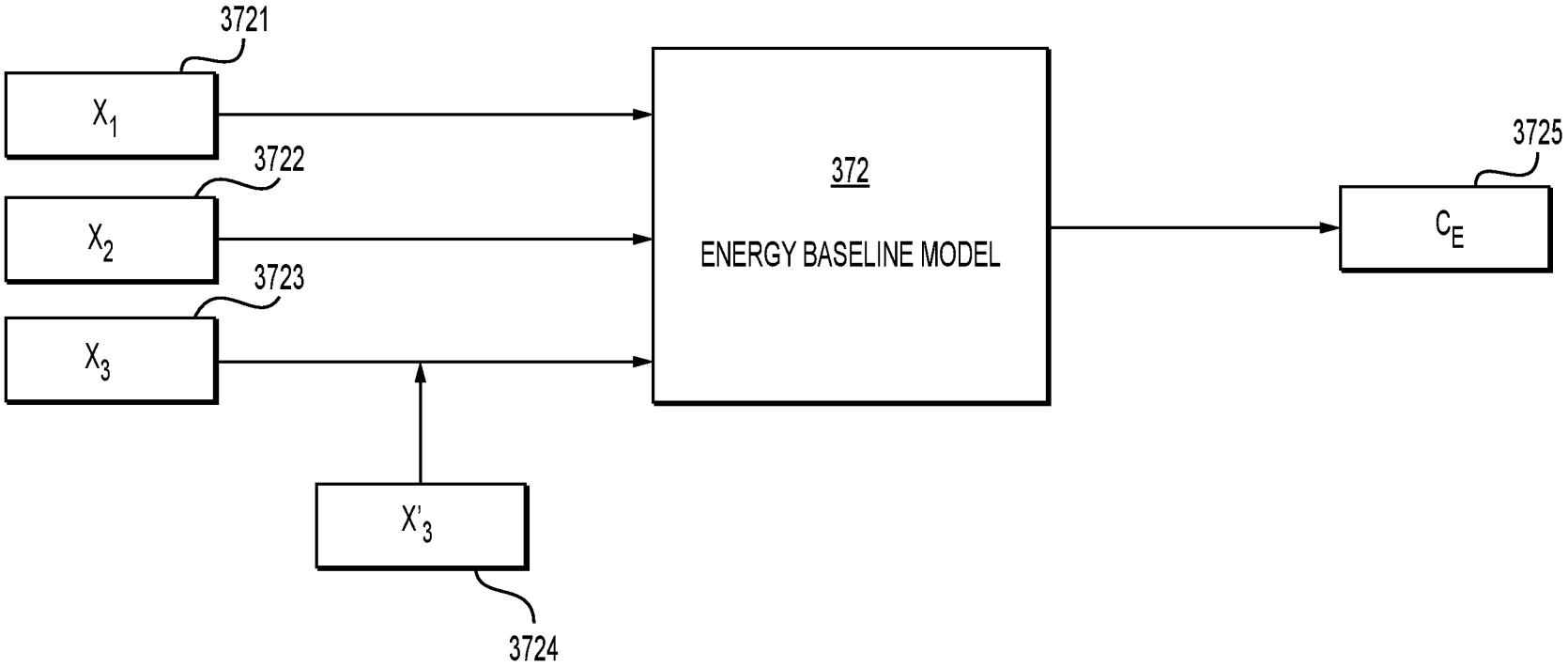
FIG. 6 depicts a block diagram of the inputs and outputs of the baseline model of FIG. 2.

FIG. 6 describes the baseline model for determining the expected energy cost $C_E$ associated with a given reporting period, set to 24 hours in an exemplary embodiment. Inputs into the baseline model 372 include outside air temperature $x_1$ input at 3721, a value $x_2$ representing type of day input at 3722, such as, for example, an overcast day or a day with humidity above 90%, and other independent variables $x_3$ input at 3723 that may affect energy costs. One particular variable that is of particular concern in a post-covid environment is the ventilation rate supplied into the building, which may be input into the baseline model as an aggregated ventilation rate $x'_3$ at 3724, the aggregated ventilation rate being a sum of the ventilation rates of each of the individual air handling units in the building's HVAC system.

The aggregated ventilation rate is calculated by summing a ventilation rate for each respective air handling unit of a plurality of air handling units provided in the building HVAC system, and dividing by the total number of air handling units, to arrive at a weighted average flow rate. The ventilation rate for a particular air handling unit is calculated by multiplying a first value representing the damper position of the air handling unit and a second value representing the size of the air handling unit.

The first value may range from 0 to 100 indicating a percentage of openness of the damper of the air handling unit, with 0 representing a completely closed damper position and no airflow through the air handling unit, and 100 representing a completely open damper position and maximum airflow through the air handling unit. The second value may be any convenient indication of the size of each air handling unit, as long as it is consistent for each air handling unit. Examples of useful measures for the second value include intake diameters, cross-sectional areas at the inlet, power rating, etc.

Expressed mathematically, the aggregated ventilation rate, AVR may be written as:

$$AVR=(w_1*OAD_1+w_2*OAD_2+\ldots+w_n*OAD_n)/(w_1+w_2+\ldots+w_n)$$

where:

$OAD_n$ is a damper position between 0 and 100, where "OA" indicates that this is a damper for an air handling unit bringing in outside air, and $w_n$ is the second value representing the weight of a particular air handling unit in the equation based on the size of the air handling unit. The relative size of the particular air handling unit affects its contribution to the aggregated ventilation rate and thus to the total energy costs. This then allows for a model to output the expected energy cost for a reporting period, such that the present invention may use that baseline model to report the energy savings associated with the energy optimization performed at the cloud on the building in the reporting period.

Program aspects of the technology may be thought of as "products" or "articles of manufacture" typically in the form of executable code and/or associated data that is carried on or embodied in a type of machine-readable medium. "Storage" type media include any or all of the tangible memory of the computers, processors or the like, or associated modules thereof, such as various semiconductor memories, tape drives, disk drives and the like, which may provide non-transitory storage at any time for the software programming. All or portions of the software may at times be communicated through the Internet or various other telecommunication networks. Such communications, for example, may enable loading of the software from one computer or processor into another, for example, from a management server or host computer of the mobile communication network into the computer platform of a server and/or from a server to the mobile device. Thus, another type of media that may bear the software elements includes optical, electrical and electromagnetic waves, such as used across physical interfaces between local devices, through wired and optical landline networks and over various airlinks. The physical elements that carry such waves, such as wired or wireless links, optical links, or the like, also may be considered as media bearing the software. As used herein, unless restricted to non-transitory, tangible "storage" media, terms such as computer or machine "readable medium" refer to any medium that participates in providing instructions to a processor for execution.

It would also be apparent to one of skill in the relevant art that the present disclosure, as described herein, can be implemented in many different embodiments of software, hardware, firmware, and/or the entities illustrated in the figures. Any actual software code with the specialized control of hardware to implement embodiments is not limiting of the detailed description. Thus, the operational behavior of embodiments will be described with the understanding that modifications and variations of the embodiments are possible, given the level of detail presented herein.

The systems, apparatuses, devices, and methods disclosed herein are described in detail by way of examples and with reference to the figures. The examples discussed herein are examples only and are provided to assist in the explanation of the apparatuses, devices, systems, and methods described herein. None of the features or components shown in the drawings or discussed below should be taken as mandatory for any specific implementation of any of these the apparatuses, devices, systems, or methods unless specifically designated as mandatory. For ease of reading and clarity, certain components, modules, or methods may be described solely in connection with a specific figure. In this disclosure, any identification of specific techniques, arrangements, etc. are either related to a specific example presented or are merely a general description of such a technique, arrangement, etc. Identifications of specific details or examples are not intended to be, and should not be, construed as mandatory or limiting unless specifically designated as such. Any failure to specifically describe a combination or sub-combination of components should not be understood as an indication that any combination or sub-combination is not possible. It will be appreciated that modifications to disclosed and described examples, arrangements, configurations, components, elements, apparatuses, devices, systems, methods, etc. can be made and may be desired for a specific application. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

Throughout this disclosure, references to components or modules generally refer to items that logically can be grouped together to perform a function or group of related functions. Like reference numerals are generally intended to refer to the same or similar components. Components and modules can be implemented in software, hardware, or a combination of software and hardware. The term "software" is used expansively to include not only executable code, for example machine-executable or machine-interpretable instructions, but also data structures, data stores and computing instructions stored in any suitable electronic format, including firmware, and embedded software. The terms "information" and "data" are used expansively and includes a wide variety of electronic information, including executable code; content such as text, video data, and audio data, among others; and various codes or flags. The terms "information," "data," and "content" are sometimes used interchangeably when permitted by context.

It is to be understood that both the foregoing general description and the following detailed description are exemplary and explanatory only and are not restrictive of the disclosed embodiments, as claimed.

Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A computer-implemented method for energy optimization of an HVAC system of a building, the method comprising:

collecting, using at least one processor, data from field sensors, the data including damper positions of a plurality of air handling units;

calculating, using the at least one processor, an aggregated ventilation rate for the air handling units based on the damper positions, wherein the calculation of the aggregated ventilation rate comprises summation of a ventilation rate for each respective air handling unit of the plurality of air handling units and dividing by a total number of air handling units, the ventilation rate for a respective air handling unit is calculated by multiplying a first value representing the damper position of the respective air handling unit of the plurality of air handling units and a second value representing a size of the respective air handling unit;

retrieving, using the at least one processor, a predictive model that outputs a predicted state for a plurality of building zones;

inputting, using the at least one processor, the damper positions to the predictive model;

retrieving, using the at least one processor, a baseline model that outputs an expected energy cost for a reporting period;

inputting, using the at least one processor, the aggregated ventilation rate to the baseline model;

performing, using the at least one processor, batch data analytics on the predictive model to update a building model;

retrieving, using the at least one processor, energy cost information;

optimizing, using the at least one processor, energy use to minimize actual energy cost based on the building model, the energy cost information, and the data collected from the field sensors;

wherein the step of optimizing energy use includes determining operational set points for equipment in the HVAC system;

transmitting, using the at least one processor, determined operational setpoints to one or more HVAC controllers;

adjusting, by the one or more HVAC controllers, at least one HVAC equipment parameter based on the determined operational setpoints;

generating, using the at least one processor, energy savings data based on the baseline model and the actual energy cost; and sending the energy savings data to be displayed at a user portal for visualization and notification.

2. The method of claim 1, wherein the HVAC equipment includes a chiller plant and a boiler plant.

3. The method of claim 2, wherein the equipment further includes the air handling units.

4. The method of claim 1, wherein the steps of performing batch data analytics and optimizing energy use are performed with greater frequency than the steps of generating energy savings data and sending the energy savings data to be displayed at the user portal.

5. The method of claim 4, wherein the steps of performing batch data analytics and optimizing energy use are performed every 15 minutes and the steps of generating energy savings data and sending the energy savings data to be displayed at the user portal are performed every 24 hours.

6. The method of claim 1, wherein the first value is a number between 0 and 100 representing a percentage of air flow through the respective air handling unit.

7. The method of claim 1, wherein the second value is a cross-sectional area of an inlet of the respective air handling unit.

8. The method of claim 1, wherein the step of performing batch data analytics on the predictive model to update the building model comprises perturbing input variables to the predictive model.

9. The method of claim 2, further including inputting to the predictive model values reflecting temperatures of the building zones, past set points for the equipment in the HVAC system, and outside air temperature.

10. A system for energy optimization of HV AC for a building, the system comprising: a memory having processor-readable instructions therein; and at least one processor configured to access the memory and execute the processor-readable instructions, which when executed by the processor configures the processor to perform a plurality of functions, including functions for:

collecting data from field sensors, the data including damper positions of a plurality of air handling units;

calculating an aggregated ventilation rate for the air handling units based on the damper positions, wherein the calculation of the aggregated ventilation rate comprises summation of a ventilation rate for each respective air handling unit of the plurality of air handling units and dividing by a total number of air handling units, wherein the ventilation rate for a respective air handling unit comprises multiplying a first value representing the damper position of the respective air handling unit of the plurality of air handling units and a second value representing a size of the respective air handling unit;

retrieving a predictive model that outputs a predicted state for a plurality of building zones;

inputting the damper positions to the predictive model;

retrieving a baseline model that outputs an expected energy cost for a reporting period;

inputting the aggregated ventilation rate to the baseline model;

performing batch data analytics to on the predictive model to update a building model;

retrieving energy cost information;

optimizing energy use to minimize actual energy cost based on the building model, the energy cost information, and the data collected from the field sensors;

wherein the step of optimizing energy use includes determining operational set points for equipment in the HVAC system;

transmitting, using the at least one processor, determined operational setpoints to one or more HVAC controllers;

adjusting, by the one or more HVAC controllers, at least one HVAC equipment parameter based on the determined operational setpoints;

generating energy savings data based on the baseline model and the actual energy cost; and sending the energy savings data to be displayed at a user portal for visualization and notification.

11. The system of claim 10, wherein the first value is a number between 0 and 100 representing a percentage of air flow through the respective air handling unit.

12. The system of claim 10, wherein the second value is a cross-sectional area of an inlet of the respective air handling unit.

13. The system of claim 10, wherein performing batch data analytics on the predictive model to update the building model comprises perturbing input variables to the predictive model.

14. A non-transitory computer-readable medium containing instructions for energy optimization of HVAC for a building, comprising:

collecting data from field sensors, the data including damper positions of a plurality of air handling units;

calculating an aggregated ventilation rate for the air handling units based on the damper positions, wherein the calculation of the aggregated ventilation rate comprises summation of a ventilation rate for each respective air handling unit of the plurality of air handling units and dividing by a total number of air handling units, wherein the ventilation rate for a respective air handling unit comprises multiplying a first value representing the damper position of the respective air handling unit of the plurality of air handling units and a second value representing a size of the respective air handling unit;

retrieving a predictive model that outputs a predicted state for a plurality of building zones;

inputting the damper positions to the predictive model;

retrieving a baseline model that outputs an expected energy cost for a reporting period;

inputting the aggregated ventilation rate to the baseline model;

performing batch data analytics to on the predictive model to update a building model;

retrieving energy cost information;

optimizing energy use to minimize actual energy cost based on the building model, the energy cost information, and the data collected from the field sensors;

transmitting, using the at least one processor, optimized equipment set points to one or more HVAC controllers:

adjusting, by the HVAC controllers, at least one HV AC equipment parameter based on the optimized equipment set points;

wherein the step of optimizing energy use includes determining operational set points for equipment in the HVAC system;

transmitting, using the at least one processor, determined operational setpoints to one or more HVAC controllers;

adjusting, by the one or more HVAC controllers, at least one HVAC equipment parameter based on the determined operational setpoints;

generating energy savings data based on the baseline model and the actual energy cost; and sending the energy savings data to be displayed at a user portal for visualization and notification.

15. The non-transitory computer-readable medium of claim 14, wherein performing batch data analytics on the predictive model to update the building model comprises perturbing variables to the predictive model.

16. The non-transitory computer-readable medium of claim 14, wherein the first value is a number between 0 and 100 representing a percentage of air flow through the respective air handling unit.

17. The non-transitory computer-readable medium of claim 14, wherein the second value is a cross-sectional area of an inlet of the respective air handling unit.

* * * * *